US006648326B2

(12) United States Patent
Hieb

(10) Patent No.: US 6,648,326 B2
(45) Date of Patent: Nov. 18, 2003

(54) DELIVERY FOR A MACHINE PROCESSING FLAT PRINTING MATERIALS

(75) Inventor: Christian Hieb, Neuhofen (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 65 days.

(21) Appl. No.: 09/918,058

(22) Filed: Jul. 30, 2001

(65) Prior Publication Data

US 2002/0014170 A1 Feb. 7, 2002

(30) Foreign Application Priority Data

Jul. 28, 2000 (DE) ..... 100 37 119

(51) Int. Cl.[7] ..... B65H 29/68
(52) U.S. Cl. ..... 271/183; 271/194; 271/204
(58) Field of Search ..... 271/204, 205, 271/207, 183, 194

(56) References Cited

U.S. PATENT DOCUMENTS

| | | | | |
|---|---|---|---|---|
| 3,307,818 A | | 3/1967 | Cocito | |
| 4,572,071 A | | 2/1986 | Cappel et al. | |
| 5,031,002 A | | 7/1991 | Yaguchi | |
| 5,497,987 A | * | 3/1996 | Henn et al. | 271/204 |
| 5,505,124 A | | 4/1996 | Esposito | |
| 5,988,633 A | * | 11/1999 | Henn et al. | 271/204 |
| 6,000,695 A | * | 12/1999 | Mack et al. | 271/183 X |
| 6,213,462 B1 | * | 4/2001 | Schmidt | 271/204 |
| 6,273,417 B1 | * | 8/2001 | Berlingen et al. | 271/183 |
| 6,315,287 B1 | * | 11/2001 | Hirth et al. | 271/204 X |

FOREIGN PATENT DOCUMENTS

| | | |
|---|---|---|
| DE | 3411029 C2 | 10/1987 |
| DE | 4406739 C2 | 6/1997 |
| DE | 19857745 A1 | 6/2000 |
| JP | 01110449 A | 4/1989 |

* cited by examiner

*Primary Examiner*—David H. Bollinger
(74) *Attorney, Agent, or Firm*—Laurence A. Greenberg; Werner H. Stemer; Gregory L. Mayback

(57) ABSTRACT

A delivery for a machine for processing flat printing materials, includes a sheet guide surface with suction openings opening into the sheet guide surface, a suction chamber communicating with the suction openings, and a sheet conveyor for gripping a respective sheet at an edge thereof extending in a sheet-conveying direction and for dragging the respective sheet over the sheet guide surface, the suction chamber being formed as a throttling duct; a machine for processing flat printing materials including the delivery; and a sheet-processing printing machine including the delivery.

7 Claims, 2 Drawing Sheets

DELIVERY FOR A MACHINE PROCESSING FLAT PRINTING MATERIALS

BACKGROUND OF THE INVENTION

Field of the Invention

The invention relates to a delivery for a machine processing flat printing materials, in particular a sheet-processing printing machine, having a sheet guide surface, suction openings opening into the sheet guide surface, a suction chamber communicating with the suction openings, and a sheet conveyor for gripping a respective sheet at an edge thereof leading in a conveying direction and dragging it over the sheet guide surface, and also to a machine for processing flat printing materials, which is equipped with the delivery.

The aforementioned delivery drags sheets printed on one side thereof over the sheet guide surface in such a way that the unprinted side of the sheets (in the case of recto or Single-side printing) is attracted by suction in a direction towards the sheet guide surface. A delivery of this type is disclosed, for example, by the published German Patent Document DE 34 11 029 C2 and is representative of the prior art, to the extent that air nozzles provided therein, which open into the sheet guide surface, communicate at least to some extent with a vacuum generator and are directly connected to ducts which, in the case of recto printing, are in particular connected to the suction side of fans or blowers. The objective which is pursued with this device is to achieve quiet running of the sheets over the sheet guide surface. To this end, a relatively high output from the respective fan or blower is required, because in no operating state are all the air nozzles covered by sheets and, therefore, unwanted air is sucked through some of these air nozzles, which results in a condition wherein, even with a high output from the fans, only low suction forces act upon the sheets dragged over the sheet guide surface, so that quiet running of the sheets can be achieved only with an extremely high outlay of power.

SUMMARY OF THE INVENTION

It is accordingly an object of the invention to configure the delivery referred to at the introduction hereto in such a manner that a quiet or smooth sheet run is achieved with the lowest possible outlay of power for the generation of suction forces which are required to guide the sheets along the sheet guide surface.

With the foregoing and other objects in view, there is provided, in accordance with one aspect of the invention, a delivery for a machine for processing flat printing materials, comprising a sheet guide surface with suction openings opening into the sheet guide surface, a suction chamber communicating with the suction openings, and a sheet conveyor for gripping a respective sheet at an edge thereof extending in a sheet-conveying direction and for dragging the respective sheet over the sheet guide surface, the suction chamber being formed as a throttling duct.

In accordance with another feature of the invention, the suction openings are subdivided into groups, each group of a plurality of groups selected from the groups of suction opening being assigned to a respective throttling duct exclusively.

In accordance with a further feature of the invention, a respective throttling duct assigned to the groups of suction openings has an extent in the conveying direction which is at most equal to a corresponding extent of smallest possible sheets which can be processed.

In accordance with an added feature of the invention, a respective throttling duct has a first suction connection at an end thereof located upline with respect to the sheet-conveying direction, and has a second suction connection at an end thereof located downline from the upline end thereof.

In accordance with another aspect of the invention, there is provided a machine for processing flat printing materials, including a delivery, comprising a sheet guide surface with suction openings opening into the sheet guide surface, a suction chamber communicating with the suction openings, and a sheet conveyor for gripping a respective sheet at an edge thereof extending in a sheet-conveying direction and for dragging the respective sheet over the sheet guide surface, the suction chamber being formed as a throttling duct.

In accordance with an additional feature of the invention, the machine is a sheet-processing printing machine.

In accordance with a concomitant aspect of the invention, there is provided a sheet-processing printing machine including a delivery, comprising a sheet guide surface with suction openings opening into the sheet guide surface, a suction chamber communicating with the suction openings, and a sheet conveyor for gripping a respective sheet at an edge thereof extending in a sheet-conveying direction and for dragging the respective sheet over the sheet guide surface, the suction chamber being formed as a throttling duct.

A result of the improved construction, compared with the heretofore known delivery according to the aforementioned patent document, is a lower drop in the vacuum in the suction chamber which, according to the invention, is constructed as a throttling channel and connected directly to the suction openings, as compared with the drop in vacuum in the corresponding suction chamber of the aforementioned heretofore known delivery when some of the suction openings, without a sheet covering the latter instantaneously, produce a direct connection between the suction chamber and the atmosphere. This increases the suction force exerted on the sheets by a vacuum generator as compared with the suction force exerted by a vacuum generator having an identical output in the heretofore known construction.

According to a development of the invention, the suction openings are subdivided into groups and each group is associated with its own throttling duct. In addition to further advantages explained hereinafter, this also provides production advantages as compared with an implementation of a single throttling duct underneath a guide plate provided with the suction openings.

Subdividing the suction openings into groups and allocating and configuring respective throttling ducts can be carried out in various ways.

In a preferred configuration, subdividing the suction openings and allocating throttling ducts is implemented in such a way that a respective throttling duct associated with one of the groups of suction openings has an extent in the conveying direction which is at most equal to the corresponding extent of smallest possible sheets which can be processed.

In addition, one advantageous refinement provides for a respective throttling duct to be provided with a first suction connection at an end of the throttling duct disposed upline with respect to the conveying direction, and to be provided with a second suction connection at an end of the throttling duct disposed downline from the upline throttling-duct end.

Other features which are considered as characteristic for the invention are set forth in the appended claims.

Although the invention is illustrated and described herein as embodied in a delivery for a machine processing flat printing materials, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
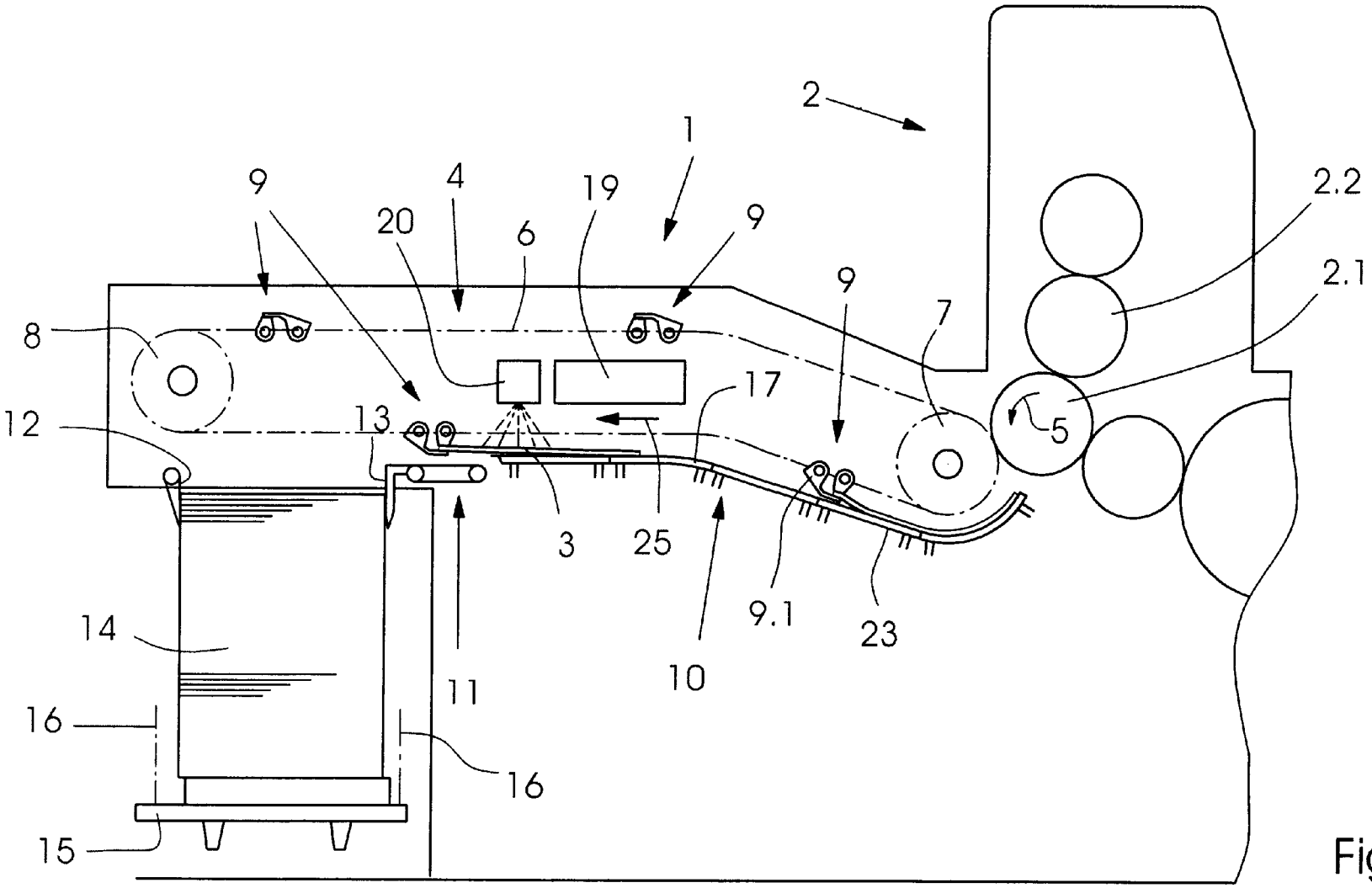
FIG. 1 is a fragmentary diagrammatic side elevational view of a sheet-processing rotary printing machine, including a delivery thereof.

Referring now to the drawings and, first, particularly to FIG. 1 thereof, there is shown therein a delivery 1 following a last processing station of a printing machine for processing flat printing materials in the form of sheets 3.

Such a processing station may be a printing unit or a post-treatment unit, such as a varnishing unit. In the exemplary embodiment at hand, the last processing station is a printing unit 2 operating in accordance with the offset process and having an impression cylinder 2.1. The latter carries a respective sheet 3, in a processing direction represented by the rotational arrow 5, through a printing nip between the impression cylinder 2.1 and a blanket cylinder 2.2 cooperating therewith, and subsequently transfers it to a sheet conveyor 4 while opening grippers which are arranged on the impression cylinder 2.1 and provided for gripping the sheet 3 at a gripper margin located at a leading end of the respective sheet 3. The sheet conveyor 4 includes two conveyor chains 6, a respective one of which revolves along a respective side wall of the delivery 1 during operation. A respective conveying chain 6 wraps around each of two synchronously driven drive sprockets 7 having mutually aligned axes of rotation and, in the exemplary embodiment, is guided, respectively, over a deflection sprocket 8 located downline from the drive sprockets 7, as viewed in the processing direction. Between the two conveying chains 6 there extend gripper systems 9 borne by the latter and having grippers 9.1, which pass through gaps provided between the grippers which are arranged on the impression cylinder 2.1 and, in this regard, accept a respective sheet 3 by gripping the aforementioned gripper margin at the leading end of the sheet 3 directly before the opening of the grippers arranged on the impression cylinder 2.1, transport the sheet over a sheet guide device 10 to a sheet brake 11, and open thereat in order to transfer the sheet 3 to the sheet brake 11. The latter imparts to the sheet a deposition speed that is reduced with respect to the processing speed and, after reaching the deposition speed, in turn releases the respective sheet 3, so that a respective, now retarded sheet 3, finally strikes leading edge stops 12 in a sheet stacking station and, being aligned on the leading edge stops 12 and on trailing edge stops 13 located opposite the leading edge stops 12, together with respective preceding and/or following sheets 3 forms a sheet pile or stack 14, which can be lowered by a lifting mechanism to the extent to which the pile or stack 14 grows. Of the lifting mechanism, there is reproduced in FIG. 1 only a platform 15 carrying the sheet pile 14, and lifting chains 16 carrying the platform and represented in phantom, i.e., by dot-dash lines.

In order to prevent mutual adhesion of the printed sheets 3 in the sheet pile 14, a dryer 19 and a powder sprayer 20 are provided on the path of the sheets 3 from the drive sprockets 7 to the sheet brake 11.

Along the paths of the sheets 3 between the drive sprockets 7, on the one hand, and the deflection sprockets 8, on the other hand, the conveying chains 6 are guided by chain guide rails, which therefore determine the chain paths of the chain runs. In the exemplified embodiment of FIG. 1, the sheets 3 are transported by the lower chain run. The section of the chain path through which the chain run passes is followed alongside by a sheet guide surface 17 facing towards it, the guide surface 17 being formed on the sheet guide device 10 and having suction openings 18 opening into it (note FIG. 3).

Figure 2:
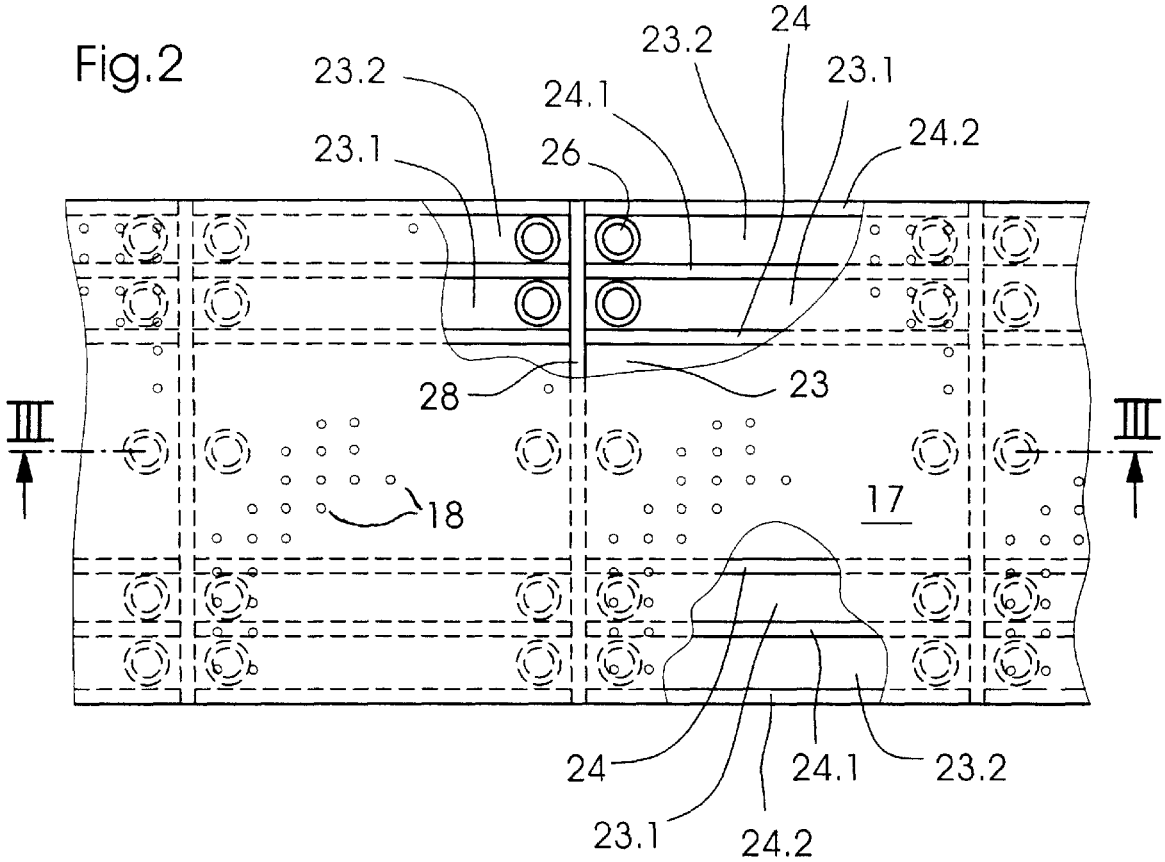
FIG. 2 is an enlarged fragmentary plan view of FIG. 1 showing part of a sheet guide device.

As indicated in FIG. 2, the suction openings 18 are distributed in the longitudinal and transverse direction, with respect to the conveying direction, over the sheet guide surface 17 which, in the case at hand, is formed on a sheet guide plate 21. Formed underneath the sheet guide plate 21 penetrated by the suction openings 18 is a throttling duct 23 in the form of a gap, which is bounded at the top by the sheet guide plate 21 and, in a configuration according to FIG. 3, is bounded at the bottom by a bottom plate 22 and, preferably, at least in the marginal regions of the sheet guide plate 21, is closed, for example by webs 24, which simultaneously fulfill the function of spacers between the sheet guide plate 21 and the bottom plate 22.

Figure 3:
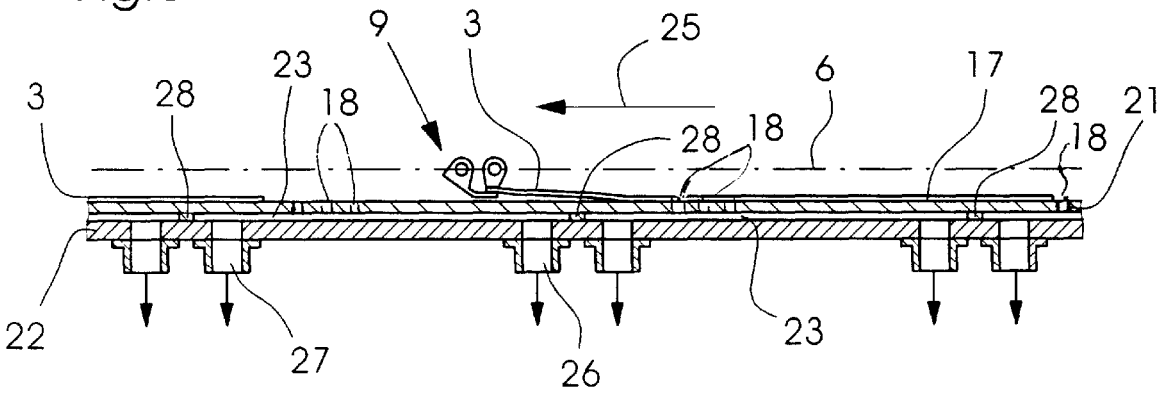
FIG. 3 is a longitudinal sectional view of FIG. 2 taken along the line III—III in the direction of the arrows, and including an instantaneous depiction or snapshot of sheets dragged over the sheet guide device.

At an upline location of an end of the throttling duct 23, as viewed in the conveying direction represented by the direction arrow 25, the throttling duct 23 is provided with a first suction connection 26 and, at an end of the throttling duct 23 located downline, there is provided therefor a second suction connection 27 and, at the respective ends of the throttling duct 23 in the exemplary embodiment according to FIG. 3, the throttling duct 23 is closed in a manner similar to the lateral closure with dividing webs 28, which extend transversely with respect to the lateral webs 24, and bridge the gap between the sheet guide plates 21 and the bottom plate 22.

A throttling duct formed in this manner, for example, is particularly advantageously placed at a section of the sheet guide device 10 wherein air would otherwise be blown under the trailing end of a sheet 3 passing the dryer 19, if the dryer blows hot air onto the sheet guide surface 17 and part of the hot air flow is deflected downwardly at the sheet guide surface 17.

In the event of a restriction to this use, the suction openings 18 distributed over the sheet guide surface 17 would be subdivided into, for example, three groups following one another in the conveying direction, and the single selected middle one of these groups would be assigned to the throttling duct 23, while the suction openings 18 disposed upline and downline with respect to the middle group can be connected, for example, to a respective suction chamber heretofore known from the prior art.

FIGS. 2 and 3 show a configuration differing therefrom, wherein a plurality of groups of suction openings 18 following one another in the conveying direction have a respective throttling duct 23 assigned thereto. In the example shown here, of all the suction openings 18 provided in the sheet guide surface 17, at least four groups following one another in the conveying direction are selected to communicate with a respective throttling duct 23. For the assignment to a respective throttling duct 23, selected groups of suction openings 18 can follow one another, as illustrated in FIGS. 2 and 3, but do not need to follow one another directly in the conveying direction. The placement of throttling ducts 23 can, in particular, be restricted to sections of the sheet guide device 10 which are at particular risk.

As indicated in FIG. 2, in a preferred configuration, the suction openings 18 are also subdivided into groups and assigned to respective throttling ducts 23 so that the throttling duct 23 with respect to the longitudinal direction of the sheet guide surface 17 is arranged in the middle and, in this way, communicates only with a middle part of the suction openings distributed in the transverse direction over the sheet guide surface 17, and so that, on both sides of the throttling duct 23, at least, respectively, a further group of suction openings 18 communicates with a respective throttling duct 23.1, the lateral extent of the throttling duct 23 being matched to the extent, transverse to the conveying direction, of the sheet of the smallest format processed, and the throttling duct 23, together with the throttling duct 23.1, respectively, following laterally in the transverse direction of the sheet guide surface 17, has an extent which is matched to the corresponding extent of a larger sheet format.

For even larger formats of the sheets processed, further throttling ducts 23.2, respectively, following the throttling ducts 23.1 laterally, are provided, and the throttling ducts associated with a respective format can preferably be evacuated independently of one another via the suction connections 26 and 27 thereof, so that processing smaller formats requires a lower suction output than processing larger formats.

Otherwise, in particular, also in the case of a multiplicity of throttling ducts following one another directly or indirectly in the conveying direction, the first suction connections 26 thereof, on the one hand, and the second suction connections 27 thereof, on the other hand, are connected to vacuum generators so that mutually identical operating states prevail in those of the throttling ducts wherein, respectively, there are identical relationships with respect to the covering and opening, respectively, of the suction connections 26 and 27 by the sheets 3.

I claim:

1. A delivery for a machine for processing flat printing materials, comprising a guide surface with suction openings opening into said guide surface, a suction chamber being formed as a throttling duct communicating with said suction openings, and a sheet conveyor having grippers for gripping a respective one of the flat printing materials at a leading edge thereof and for dragging the respective one of the flat printing materials in a conveying direction over said guide surface.

2. The delivery according to claim 1, wherein the machine is a sheet-processing printing machine.

3. A machine for processing flat printing materials, comprising a delivery, a guide surface with suction openings opening into said guide surface, a suction chamber being formed as a throttling duct communicating with said suction openings, and a sheet conveyor having grippers for gripping a respective one of the flat printing materials at a leading edge thereof and for dragging the respective one of the flat printing materials in a conveying direction over said guide surface.

4. A sheet-processing printing machine, comprising a delivery, a sheet guide surface with suction openings opening into said sheet guide surface, a suction chamber being formed as a throttling duct communicating with said suction openings, and a sheet conveyor having grippers for gripping a respective sheet at a leading edge thereof and for dragging the respective sheet in a conveying direction over the sheet guide surface.

5. A delivery for a machine for processing flat printing materials, the delivery comprising:

a guide surface having a plurality of groups of suction openings opening into said guide surface;

a conveyor having grippers gripping a respective one of the flat printing materials at a leading edge thereof and dragging the respective one of the flat printing materials in a conveying direction over said guide surface; and a plurality of suction chambers being formed as throttling ducts each communicating with the suction openings of a respective one of said groups of suction openings.

6. The delivery according to claim 5, wherein said throttling ducts have an extent in the conveying direction which is at most equal to a corresponding extent of a smallest possible one of the flat printing materials which can be processed.

7. The delivery according to claim 5, wherein a respective throttling duct has a first suction connection at an end thereof located upline with respect to the conveying direction, and has a second suction connection at an end thereof located downline from said upline end thereof.

* * * * *